US006736571B2

(12) United States Patent
McCarthy et al.

(10) Patent No.: US 6,736,571 B2
(45) Date of Patent: May 18, 2004

(54) REMOVAL OF DECKS FROM OFFSHORE STRUCTURES

(75) Inventors: Vincent George McCarthy, Beckenham (GB); William McGuire, Houston, TX (US); Hugh James O'Donnell, London (GB)

(73) Assignee: Saipem U.K. Limited, New Malden (GB)

( * ) Notice: Subject to any disclaimer, the term of this patent is extended or adjusted under 35 U.S.C. 154(b) by 0 days.

(21) Appl. No.: 10/181,162

(22) PCT Filed: Jan. 16, 2001

(86) PCT No.: PCT/GB01/00168

§ 371 (c)(1),
(2), (4) Date: Oct. 15, 2002

(87) PCT Pub. No.: WO01/53609

PCT Pub. Date: Jul. 26, 2001

(65) Prior Publication Data

US 2003/0108392 A1 Jun. 12, 2003

(30) Foreign Application Priority Data

Jan. 17, 2000 (GB) ..... 0001066

(51) Int. Cl.[7] ..... E02B 17/08

(52) U.S. Cl. ..... 405/209; 405/204

(58) Field of Search ..... 405/203–206, 405/209, 196; 114/264, 265; 414/137.9, 138.2, 138.5

(56) References Cited

U.S. PATENT DOCUMENTS

| | | | | |
|---|---|---|---|---|
| 2,817,212 A | * | 12/1957 | Stubbs | 405/209 |
| 4,744,697 A | * | 5/1988 | Coppens | 405/204 |
| 4,854,800 A | * | 8/1989 | Frick et al. | 414/138.2 |
| 5,829,919 A | * | 11/1998 | Heerema | 405/209 |
| 6,171,028 B1 | * | 1/2001 | Van Gelder | 405/209 |

FOREIGN PATENT DOCUMENTS

| | | |
|---|---|---|
| GB | 2165188 A | 4/1986 |
| GB | 2 303 337 A | 2/1997 |
| WO | WO 98/24980 | 6/1998 |
| WO | WO 99/43921 | 9/1999 |

* cited by examiner

*Primary Examiner*—Thomas B. Will
*Assistant Examiner*—Tara L. Mayo
(74) *Attorney, Agent, or Firm*—Frommer Lawrence & Haug LLP; Ronald R. Santucci

(57) ABSTRACT

A method of removing a deck from an offshore structure is provided. An apparatus for carrying out the method is also described.

27 Claims, 14 Drawing Sheets

REMOVAL OF DECKS FROM OFFSHORE STRUCTURES

CROSS-REFERENCE TO RELATED APPLICATIONS

This application is a 371 of PCT/GB01/00168 filed on Jan. 16, 2001, now WO 01/53609 A1 published Jul. 26, 2001, and claims priority benefits of Great Britain patent application, GB 0001066.0 filed Jan. 17, 2000.

BACKGROUND OF THE INVENTION (1) Field of the Invention

This invention relates to a method of removing a deck from an offshore structure and to a vessel suitable for use in such a method.

There are many structures, for example in the North Sea, that have been built and installed on the seabed for purposes connected with the offshore oil and gas industries. Such structures commonly comprise a supporting framework, usually referred to as a jacket, which stands on the seabed and extends up to a height above sea level, and a superstructure, often referred to as a deck, supported above sea level on the jacket. A jacket typically comprises a plurality of legs extending upwardly from the seabed to the top of the jacket and diagonal and cross bracing that together hold the legs against relative lateral movement; the vertical load carried by the jacket is borne principally by the legs. The nature of the deck is dependent upon the purpose of the structure. For example, it would commonly comprise principally a drilling rig but might consist exclusively of accommodation for workers on an adjacent rig. During installation, the jacket is commonly located in position on the seabed first and the deck thereafter placed on top of the jacket. The deck may be built as a single unit onshore, taken out to sea and placed on top of the jacket, or it may be built as a number of separate modules that are taken separately to the jacket and assembled only as they are placed on the jacket. Modules can also be added to a deck that has previously been placed on a jacket at a later stage to enhance or alter the capabilities of the deck.

It will be appreciated that the form of superstructure and the form of the supporting structure vary considerably from one structure to another and the terms "deck" and "jacket" as used herein need to be understood as correspondingly broad.

(2) Description of Related Art

As environmental considerations assume greater importance, so the need increases for satisfactory methods of removing a deck from a jacket of an offshore structure after the useful life of the structure is over. One way that may be adopted is to use a vessel with a large crane to lift the deck from the jacket and place it on a barge. Many other options have, however, also been proposed and in some cases also used in practice; in some of these options a floating vessel, which in plan view is generally U shape, is moved up to the structure with the opposite limbs of the "U" on opposite sides of the structure and some system, which may be a ballasting or a jacking system, used to lift the deck clear of the jacket.

In practice, however, it has proved difficult to provide a method of removing a deck from an offshore structure that (1) is able to remove a relatively large and heavy deck, (2) is able to bring the deck inshore all the way to a yard and (3) does not require a very great investment in equipment.

BRIEF SUMMARY OF THE INVENTION

It is an object of the invention to provide a method of removing a deck from an offshore structure that overcomes at least partly some or all of the difficulties referred to.

According to the invention there is provided a method of removing a deck from an offshore structure including a deck supported on a jacket, the method including the following steps:

a) positioning a floating vessel around the jacket with respective parts of the vessel on opposite sides of the jacket and trusses extending between the opposite parts of the vessel, b) engaging parts of the trusses with legs of the jacket, c) securing the trusses to the jacket, d) relieving the load carried by portions of the legs of the jacket, e) cutting through the portions of the,legs of the jacket to divide the jacket into a lower part and an upper part carrying the deck, the trusses being secured to the upper part of the jacket, f) transferring the weight of the upper part of the jacket and of the deck via the trusses to the floating vessel, and g) removing the floating vessel, with the trusses, the upper part of the jacket and the deck supported thereon, from the vicinity of the lower part of the jacket.

In the method just defined the steps are set out in one particular order which is the preferred order, but it should be understood that it is within the scope of the invention to make some alterations to the order. For example, it is within the scope of the invention for the step of relieving the load carried by portions of the legs of the jacket to be carried out before the trusses are secured to the jacket.

By cutting through the jacket below its top and then removing the deck by supporting the uppermost part of the jacket, rather than trying to remove the deck from the top of the jacket, a more reliable support of the deck is ensured: by continuing to support the deck through the jacket the nature of the support for the deck itself remains unchanged and therefore there can be confidence of adequate support for the deck; if the deck were removed from the jacket, however, the nature of its support would almost inevitably change and therefore there could be less confidence that its support would be satisfactory, especially in the case of a deck of modular construction and/or a deck to which structural alterations had been made subsequent to installation. Where reference is made herein to "cutting" a leg it should be understood that the term should not be regarded as restricted to any particular method of creating a separation of upper and lower parts of a leg; methods that may be employed and are to be regarded as cutting include, for example, a shearing action, application of heat and explosive methods.

Usually it will be advantageous for the trusses to be secured to the jacket above sea level. Also it will usually be advantageous for the legs to be cut above sea level.

The floating vessel preferably includes two barges, which may or may not be identical, for positioning on opposite sides of the jacket. The barges preferably are able to be separated and be used for another purpose as individual barges. Constructing the vessel in this way enables the cost of the vessel to be reduced.

Preferably the barges are connected together side-by-side with a space therebetween, by front and rear trusses, which preferably are detachably connected to the barges.

One of the trusses may be retractable, preferably by being separated into two parts, to leave an open-ended space between the barges. In such a case, step (a) of positioning the floating vessel preferably includes the sequential steps of retracting the retractable truss, positioning the vessel around the jacket with the barges on opposite sides of the jacket and the jacket positioned within the open-ended space, and returning the retracted truss to a position in which it extends across the gap between the barges on the opposite side of the jacket from the other truss.

As an alternative to the procedure described immediately above, step (a) of positioning the floating vessel around the jacket may include the following steps:

i) positioning the vessel adjacent to the jacket with one of the trusses immediately adjacent to the jacket, ii) releasing the truss that is immediately adjacent to the jacket from the vessel, and iii) moving the vessel away from the jacket and then to an opposite side of the jacket and repositioning the vessel around the jacket with respective parts of the vessel on first and second opposite sides of the jacket and the trusses extending between the opposite parts of the vessel on third and fourth opposite sides of the jacket.

The truss that is immediately adjacent to the jacket is preferably mounted on a buoyancy unit which supports at least most of the weight of the truss when the truss is released from the vessel. That avoids the need to have the offshore structure supporting the weight of the truss at this stage.

Preferably the step of releasing the truss that is immediately adjacent to the jacket from the vessel includes the step of adding ballast to the vessel to lower it.

Preferably the vessel is moved to the opposite side of the jacket and repositioned around the jacket in its lowered position and then raised to bring it back into a position in which it supports the truss that was previously released from the vessel.

In the common case where the jacket is of generally rectangular section at sea level, it is preferred that the trusses are positioned alongside the longer sides of the jacket. By enclosing the jacket within the vessel the vessel is assured of remaining in position and is able to be positioned immediately adjacent to all parts of the jacket. Placing the trusses alongside the longer sides of the jacket facilitates the engagement of the trusses with legs of the jacket. It is generally preferred that the trusses engage all the legs of the jacket although in some cases that may not be desirable.

Step (b) of engaging parts of the trusses with legs of the jacket preferably includes moving movable parts of the trusses into engagement with the legs. Preferably each leg is engaged by a part of one of the trusses at two locations vertically spaced from one another. Preferably at least one collar is fixed to each leg as a preliminary step in the method and vertical loads are transferred between the legs and the trusses by the collars. The provision of such pre-installed collars facilitates the effective transfer of the large loads involved, between the legs and the trusses.

Preferably the parts of the trusses that engage the legs include grippers that are able to transfer horizontal loads between the legs and the trusses.

Preferably the method further includes the step of detaching the trusses from the vessel after the trusses are secured to the jacket. Such a step may seem surprising but represents a useful step in the procedure because it enables the time for which there is a fixed connection between the vessel, that is floating on the sea, and the offshore structure, that is stationary, to be kept to a minimum, thereby making it easier to prevent undesirable forces or movements being generated by sea movements. The step of detaching the trusses preferably includes the step of retracting jacks positioned between the vessel and the trusses; it may also or instead include the step of ballasting the vessel.

Step (d) of relieving the load carried by portions of the legs of the jacket preferably serves to reduce the vertical load carried by the portions of the legs to substantially no vertical load. Step (d) preferably involves the steps of placing jacking systems around portions of the legs of the jacket, and actuating the systems such that vertical loads previously carried through the portions of the legs are carried through the jacking systems.

Step (e) of cutting through the portions of the legs of the jacket may include the step of cutting through diagonal bracing of the jacket. As will be appreciated, it is necessary prior to step (g) to have a complete separation of the upper and lower parts of the jacket. It may also be necessary to remove or sever risers, caissons and 'J' tubes.

Step (f) of transferring the weight of the upper part of the jacket and of the deck via the trusses to the floating vessel may include, in the case where trusses have been detached from the vessel, the step of reattaching the trusses. The transfer of weight may include the step of extending jacks positioned between the vessel and the trusses, and/or the step of deballasting the vessel and/or the step of actuating jacking systems placed around the legs of the jacket. Generally it will be desirable for at least part of step (f) to be carried out relatively quickly as the vessel and the structure are liable to be most exposed to undesirable effects, for example ones caused by sea movements, during, immediately before or immediately after the transfer of weight.

The method may further include the step of taking the vessel to shore and transporting the trusses, with the upper part of the jacket and the deck supported thereon, onto the shore. Such a procedure enables the step of transferring the upper part of the jacket and the deck onto the dry land to be simplified.

The method described above is the most preferred form of the invention. Some of the features described above as being preferred or advantageous rather than essential are in themselves capable of providing considerable advantages in methods which may not include all the features (a) to (g) of the method of the invention described above (referred to hereinafter as the method according to a first aspect of the invention).

Thus according to a second aspect of the invention, there is provided a method of removing a deck from an offshore structure including a deck and a jacket, the method including the following steps:

placing jacking systems around portions of the legs of the jacket, actuating the jacking systems to relieve the load carried by the portions of the legs of the jacket, cutting through the portions of the legs of the jacket to divide the jacket into a lower part and an upper part carrying the deck, and removing the deck from the jacket.

According to a third aspect of the invention, there is provided a method of removing a deck from an offshore structure, the method including the following steps:

providing a floating vessel comprising two barges, connected together side-by-side with a space therebetween, by front and rear trusses, positioning the vessel adjacent to the structure with one of the trusses immediately adjacent to the structure, releasing the truss that is immediately adjacent to the structure from the vessel, moving the vessel away from the structure and then to an opposite side of the structure and repositioning the vessel around the structure with the barges on first and second opposite sides of the structure and the trusses extending between the barges on third and fourth opposite sides of the structure, transferring the load of the deck via the trusses to the barges, and removing the barges, with the trusses and the deck supported thereon.

According to a fourth aspect of the invention, there is provided a method of removing a deck from an offshore structure, the method including the following steps:

providing a floating vessel comprising two barges connected together side-by-side with a space therebetween, by front and rear trusses, retracting one of the trusses to leave an open-ended space between the barges, positioning the vessel around the structure with the barges on opposite sides of the structure and the structure positioned within the open-ended space, returning the retracted truss to a position in which it extends across the gap between the barges on the opposite side of the structure from the other truss, transferring the load of the deck via the trusses to the barges, and removing the barges, with the trusses and the deck supported thereon.

According to a fifth aspect of the invention, there is provided a method of removing a deck from an offshore structure including a deck supported on a jacket, the method including the following steps:

positioning a floating vessel around the jacket with respective parts of the vessel on opposite sides of the jacket and one or more trusses extending between the opposite parts of the vessel, securing the trusses to the jacket, detaching the trusses from the vessel, cutting through the jacket to divide the jacket into a lower part and an upper part carrying the deck, the trusses being secured to the upper part of the jacket, reattaching the trusses to the vessel and transferring the weight of the upper part of the jacket and of the deck via the trusses to the floating vessel, and removing the floating vessel, with the trusses, the upper part of the jacket and the deck supported thereon from the vicinity of the lower part of the jacket.

According to a sixth aspect of the invention there is provided a method of removing a deck from a jacket of an offshore structure, the method including the following steps:

bringing a floating vessel to the structure;

engaging legs of the jacket with parts of the vessel;

separating upper portions of the legs of the jacket from lower portions;

transferring an upper part of the jacket that includes the upper portion of the legs, with the deck attached thereto, onto the vessel; and removing the upper part of the jacket and the deck from the vicinity of the lower part of the jacket.

It should be understood that the method of any of the second, third, fourth, fifth or sixth aspects of the invention may further include any of the advantageous or preferred features referred to above in connection with the first aspect of the invention.

The invention still further provides a vessel suitable for carrying out any of the methods described above.

One example of a suitable vessel comprises two barges connected together side-by-side with a space therebetween, by front and rear trusses, the trusses being detachable from the barges.

BRIEF DESCRIPTION OF THE DRAWINGS

By way of example certain methods of removing a deck from a jacket of an offshore structure will now be described with reference to the accompanying schematic drawings, of which.

DETAILED DESCRIPTION OF THE INVENTION

Figure 1:
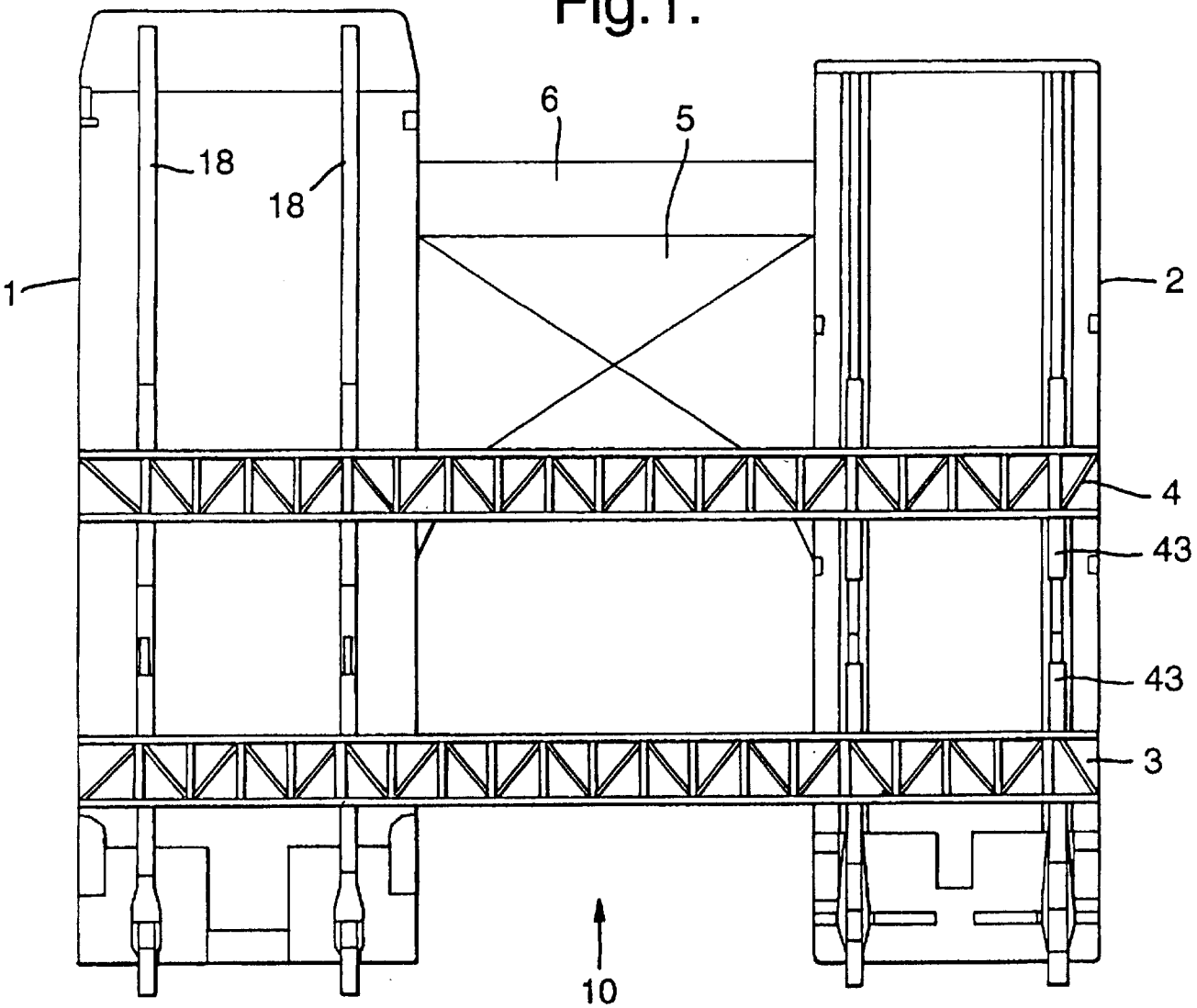
FIG. 1 is a plan view of a vessel for use in a first method.

FIG. 1 shows the vessel 10 that is employed in the first method of the invention. The vessel generally comprises two barges 1, 2 connected together by a first boxed truss 3 and a second boxed truss 4 which retain the barges 1, 2 in a spaced side-by-side relationship. A module 5, which extends for the full depth of the barges, is fitted between the barges immediately ahead of the truss 4 and an appropriately shaped assembly 6 fitted to the front of the module 5 to define a bow for the vessel. The module 5 includes a dynamic positioning system for the vessel, control systems including ballast control systems and accommodation.

In the example of the invention described, the barges 1, 2 are multi-purpose barges and are able to be used as separate barges in other situations. The trusses 3, 4, the module 5 and the bow 6 are, however, designed specifically for the removal procedure of the invention and the barges are adapted to provide appropriate mountings for the trusses. Certain requirements of those mountings will become apparent from the description of the removal procedure given below.

Figure 2A:
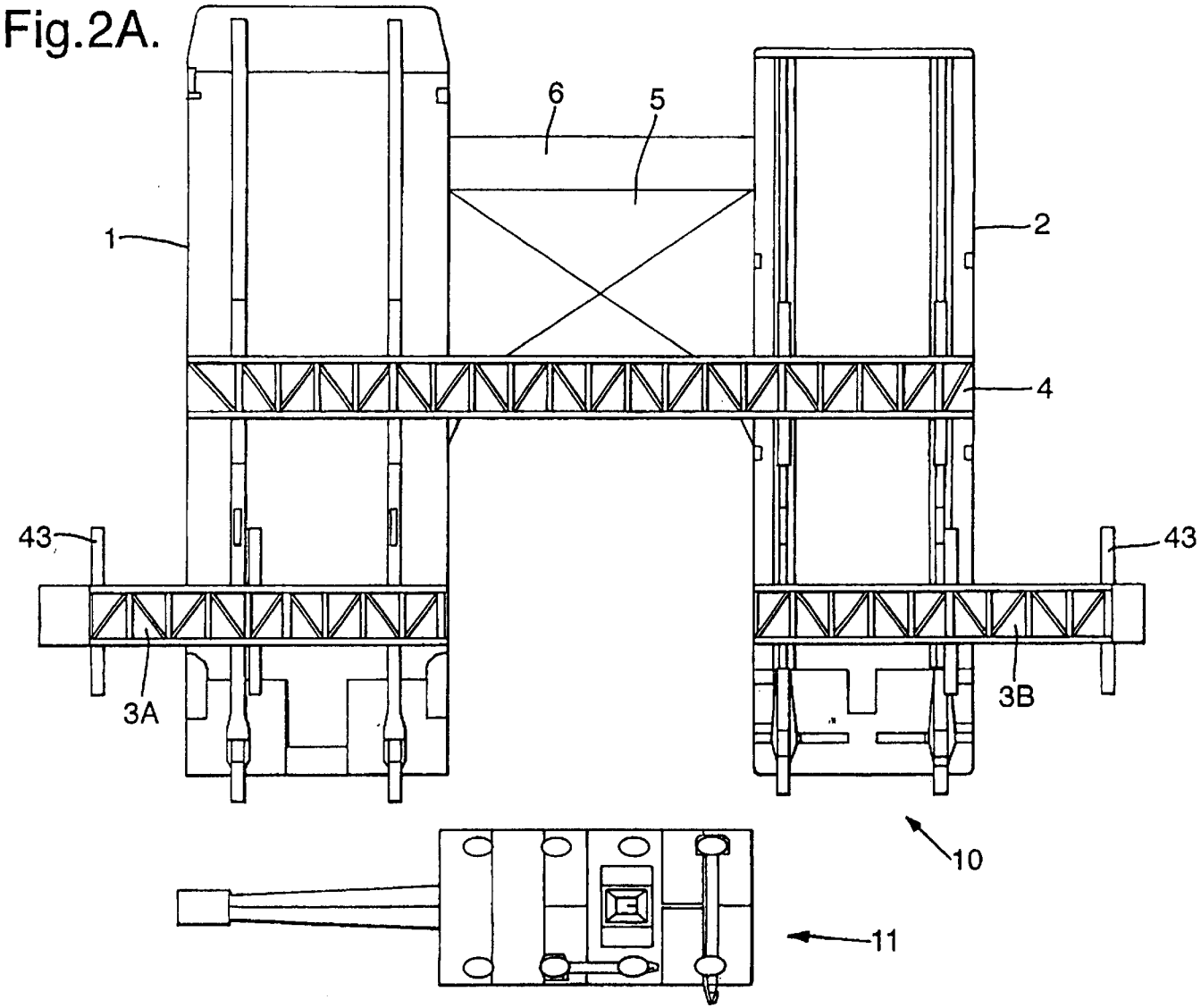
FIG. 2A is a plan view of the vessel approaching a structure.
Figure 2B:
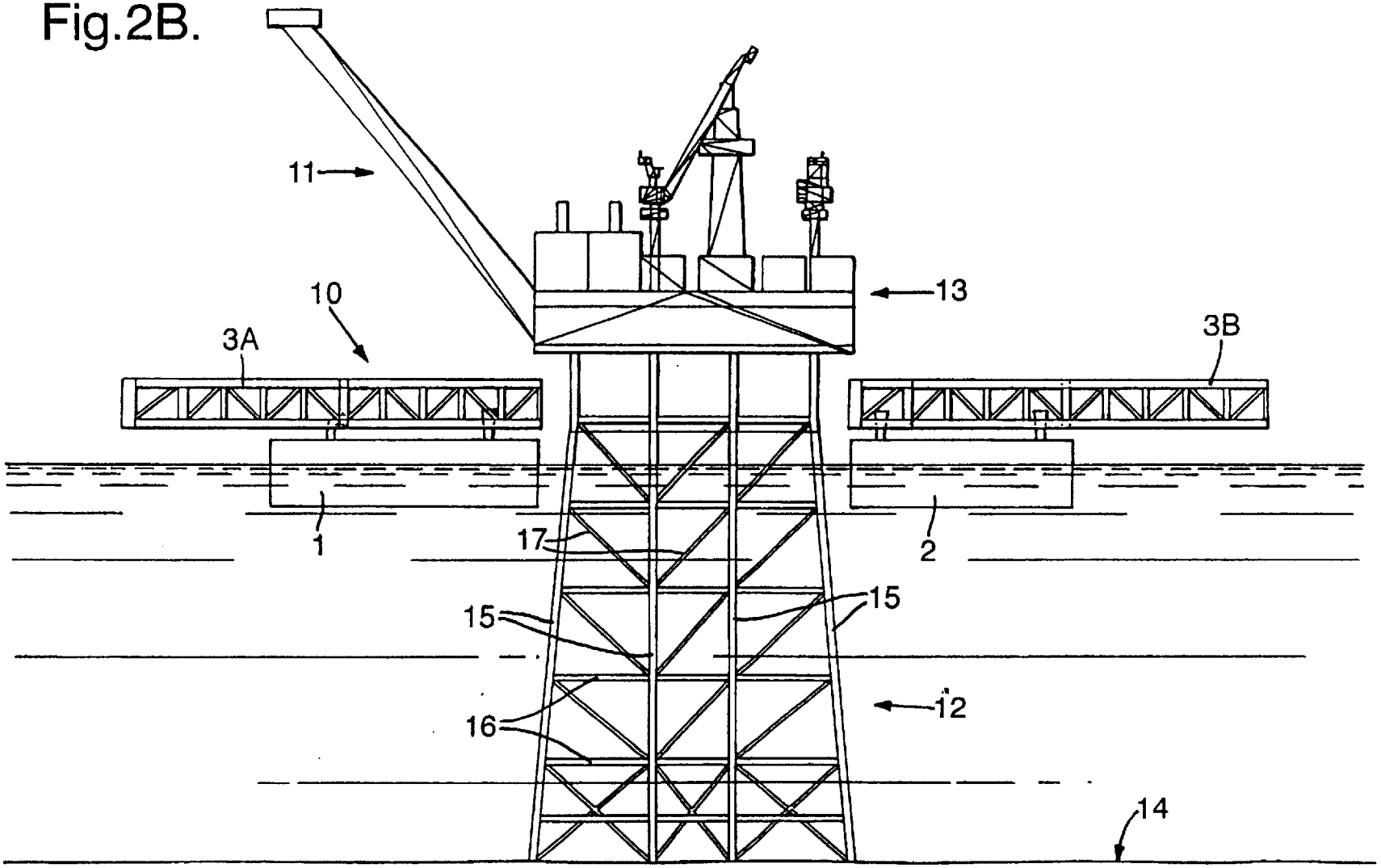
FIG. 2B is an elevation view of what is shown in plan view in FIG. 2A.

FIGS. 2A and 2B illustrate the positioning of the vessel 10 relative to an offshore structure 11 at a preparatory stage of the removal procedure. The vessel 10 will have been brought to the site by tugs. As best seen in FIG. 2B, the structure 11 is in this example a production oil rig and comprises a jacket 12 on top of which a deck 13 is mounted. The jacket 12 comprises a framework resting on the seabed 14 and including legs 15 which extend upwardly from the seabed to a height above sea level. Cross bracing 16 and diagonal bracing 17 holds the legs 15 against movement relative to one another and thereby adds strength to the structure. The weight of the deck 13 carried by the jacket is, however, carried substantially by the legs 15 alone, rather than by the bracing 16, 17.

It will be understood that the deck 13 and jacket 12 are of a construction known per se.

In FIGS. 2A and 2B, it should be noted that the truss 3 has been retracted from the position shown in FIG. 1 in which it extends between and connects the barges 1, 2 and that for this purpose the truss 3 is actually formed in two separate halves 3A and 3B which are able to be skidded laterally from the positions shown in FIG. 1 to the positions shown in FIGS. 2A and 2B (after the two halves 3A, 3B that were secured together in FIG. 1 have been unfastened). The barges 1, 2 are provided with appropriate arrangements to allow this skidding to take place.

Figure 3:
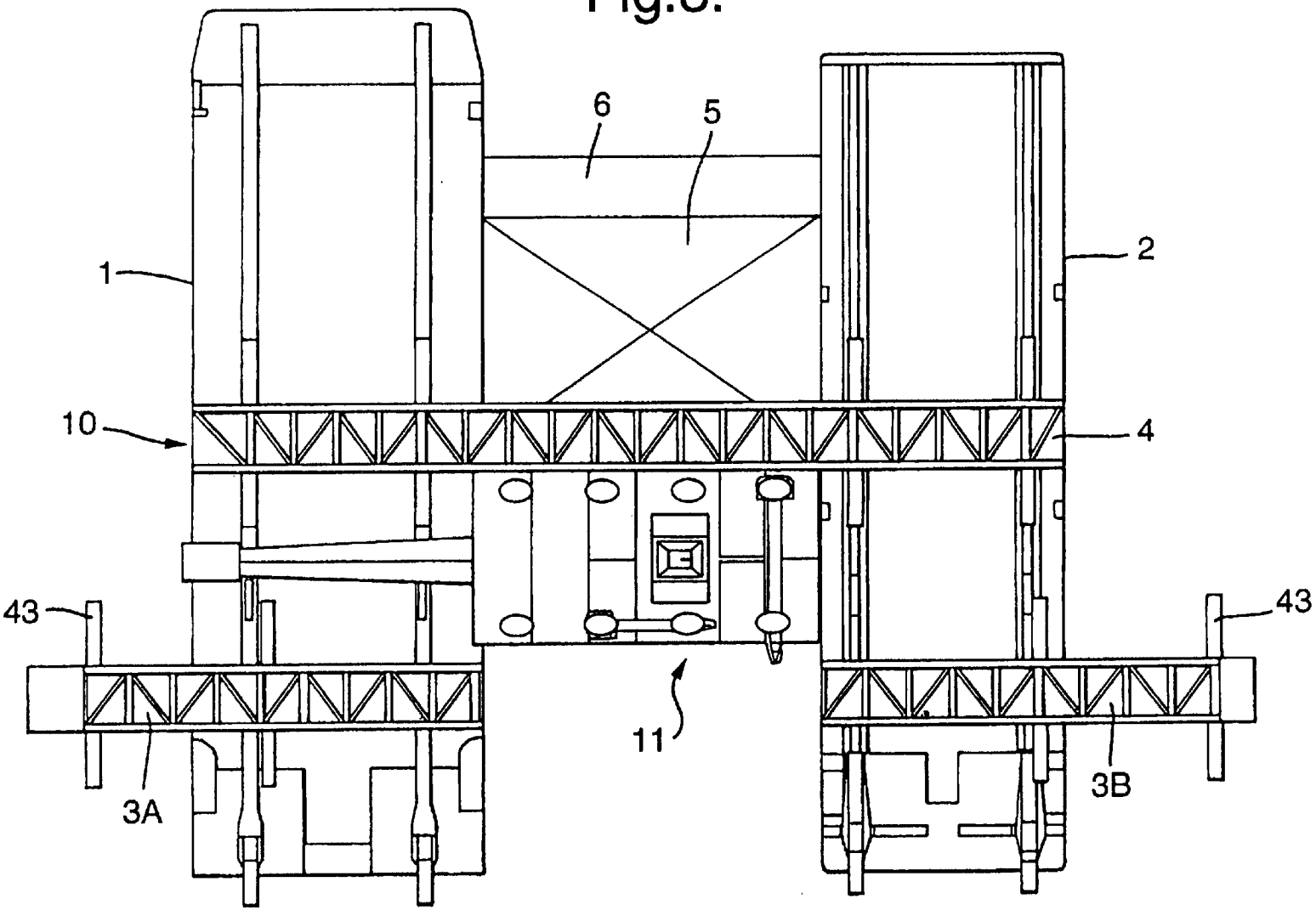
FIG. 3 is a plan view of the vessel positioned around the structure.

With the vessel 10 orientated as shown in FIGS. 2A and 2B it is manoeuvred, using a dynamic positioning system (not shown) provided on the vessel, into the position shown in FIG. 3. An active pneumatic fender system (not shown) is provided to prevent damage to either the vessel or the jacket while the vessel 10 is in position around the jacket 12. It will be understood that because the jacket is resting on the seabed and the vessel is floating there is the possibility of vertical or horizontal movement (including a rolling or pitching movement) of the vessel 10 while the jacket remains stationary. It may be necessary to remove certain boat landing areas, sea escape ladders or other equipment from the jacket 12 before the vessel 10 is brought into its final position.

The two halves 3A, 3B of the truss 3 are then skidded back to the position shown in FIG. 1 and the adjoining ends of the truss 3 secured together. The whole of the truss 3 is then skidded along the barges 1, 2 towards the truss 4 so as to arrive at the general arrangement shown in FIGS. 4A and 4B. In this case it will be seen that the trusses 3, 4 extend along opposite, longer sides of the jacket 12 and that the barges 1, 2 extend along opposite, shorter sides of the jacket. In the particular example shown each of the trusses 3, 4 lies adjacent to four respective legs 15 of the jacket.

Figure 5:
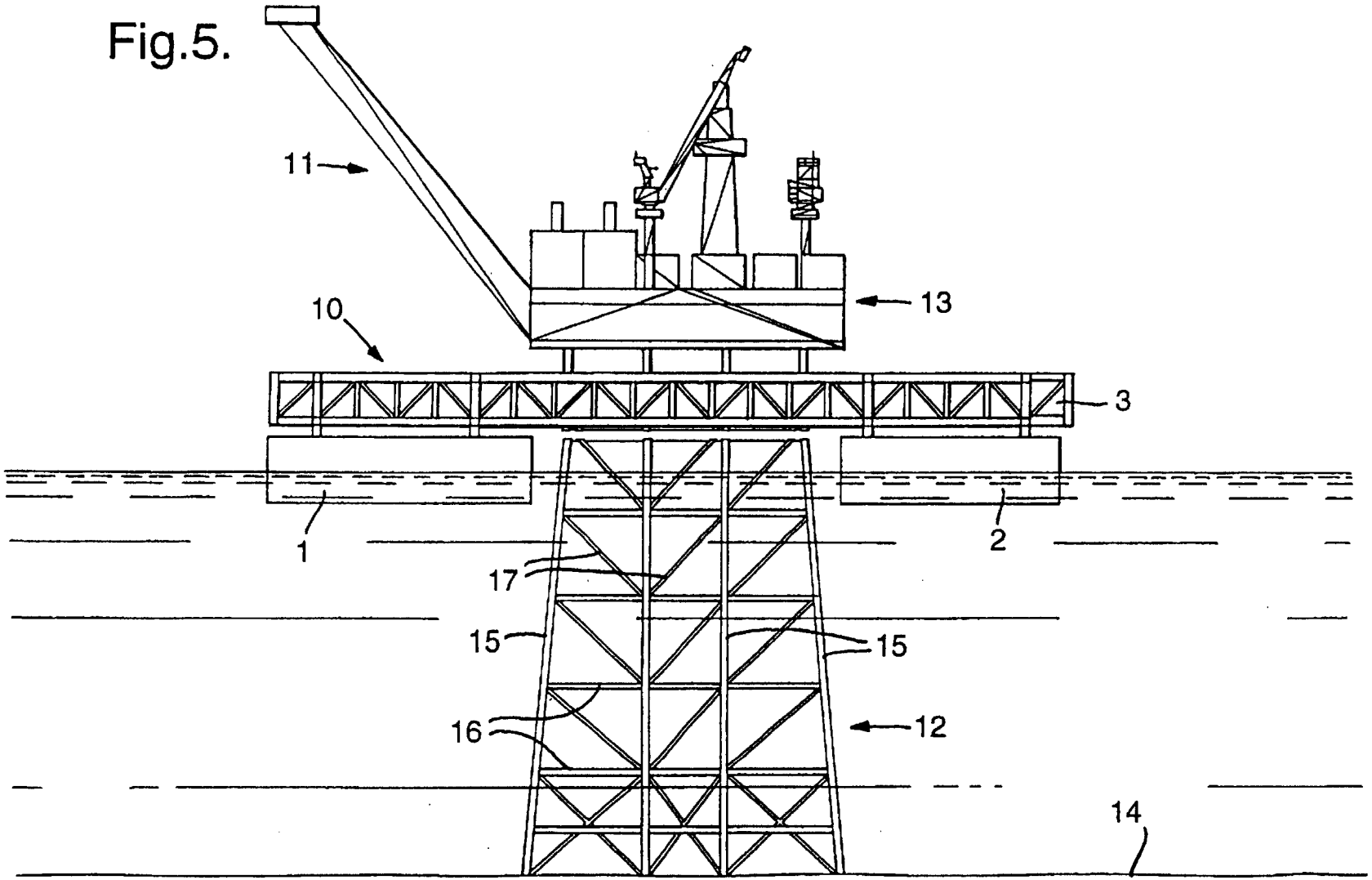
FIG. 5 is an elevation view of the vessel with the upper part of the structure separated from the lower part and carried on the vessel.

Parts of the trusses 3, 4 are then engaged with portions of the legs 15 of the jacket 12, the legs of the jacket (and any diagonal bracing) are cut and the part of the jacket above the line of the cut, together with the deck 13, lifted by the trusses 3, 4 and the barges to a position vertically clear of the remaining, lower, part of the jacket 12. That stage in the procedure is shown in FIG. 5. It will be appreciated that the cutting of the jacket legs and raising of the upper part of the structure is a critical part of the procedure and a more detailed description of it is given later.

Figure 6:
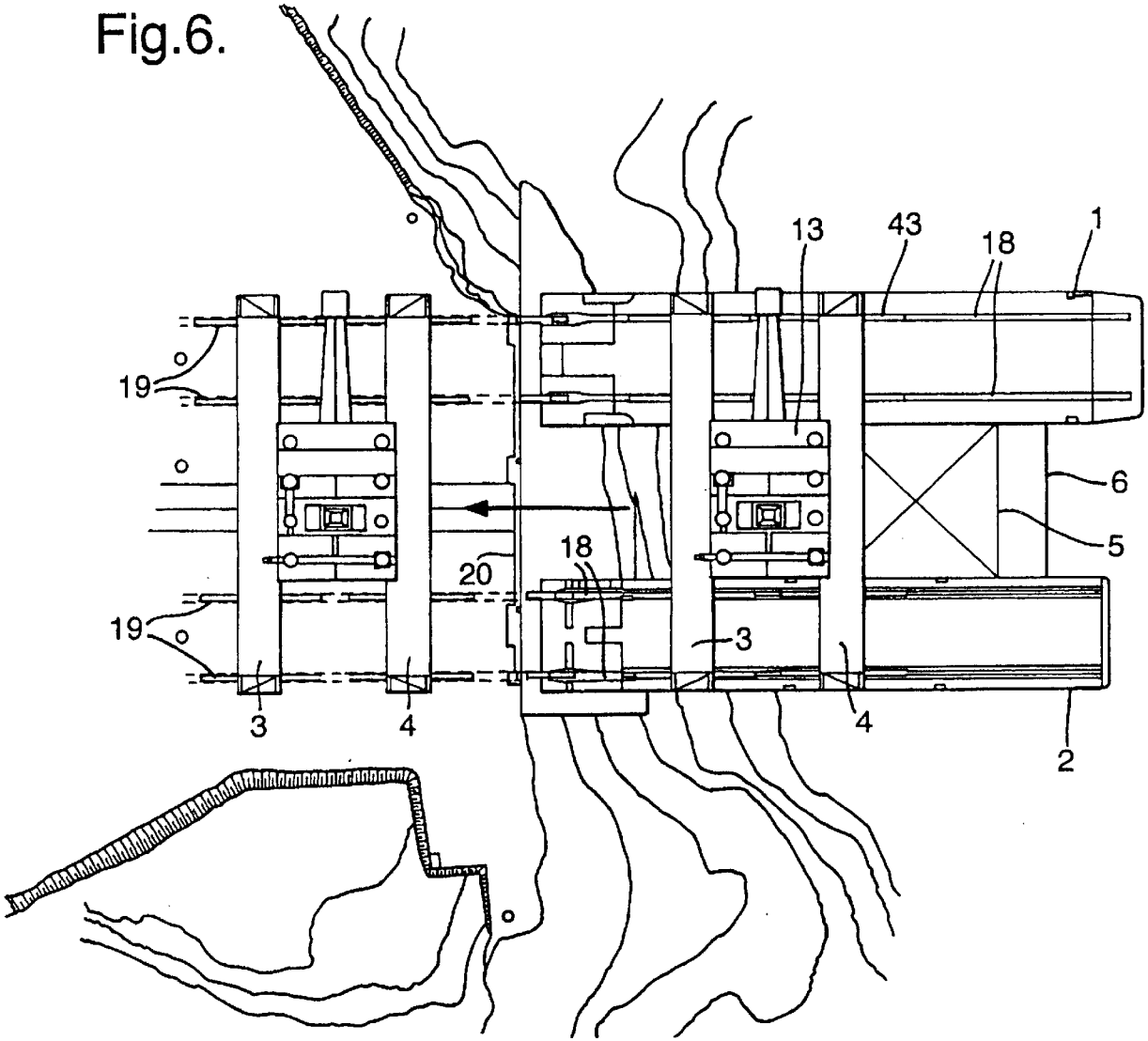
FIG. 6 is a plan view showing the structure being off-loaded from the vessel at a yard.

Once the upper part of the structure has been lifted clear as shown in FIG. 5, the vessel 10 is manoeuvred back away from the remaining, lower, part of the jacket using the dynamic positioning system. The upper part of the structure is then carried on the vessel to a quay 20 of a yard, the vessel being towed by suitable towing tugs, which may be replaced by harbour tugs in the vicinity of the yard. An advantage of the vessel 10 being formed principally of the barges 1, 2 is that the draught of the vessel can be reasonably small enabling the vessel to be docked at various yards. FIG. 6 shows the removed structure being skidded off the barges 1, 2 at a yard. It will be seen that the trusses 3, 4, the upper part of the jacket 12 and the deck 13 are all transferred to shore as a single unit. (In FIG. 6 the unit is shown both in its initial position on the vessel and in its transferred position on shore with an arrow showing the direction of movement of the unit.) The barges 1, 2 are provided with appropriate skid arrangements 18 to allow the skidding of the truss units to take place and appropriate skid beams 19 are provided on the quay. Once on the quay, the structure can be dismantled and removed from the trusses which can then be returned to the barges if the vessel is to be used again to remove another structure. Alternatively the module 5 and bow 6 can be removed from the barges 1, 2, allowing the barges to be used separately for other purposes.

In this example the two barges are not identical and it will be noted that the two hulls at the bow of the vessel are not aligned, but that the hulls are aligned at the stern.

The procedure referred to very briefly above of engaging parts of the trusses with the jacket, cutting the legs of the jacket and lifting the upper part of the jacket and the deck off the lower part of the jacket will now be described in more detail with reference to FIGS. 7 to 12.

Figure 7:
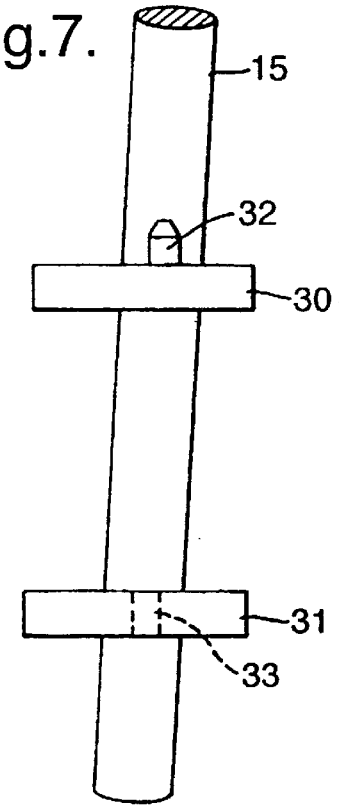
FIG. 7 is an elevation view of a portion of a leg of the jacket illustrating preparatory work carried out on the leg.

FIG. 7 illustrates certain preparatory work that is carried out on each leg 15 of the jacket 12, only one leg being shown in FIG. 7. An upper collar 30 and a lower collar 31 are fixed to the leg 15 at a preselected height above sea level and below the deck 13. The upper collar 30 is provided with a pair of diametrically opposite, upwardly projecting locating pins 32 (only one of which is visible in FIG. 7). The lower collar 31 is provided with a pair of diametrically opposite locating bores 33 (one of which is shown in dotted outline in FIG. 7).

Figure 8A:
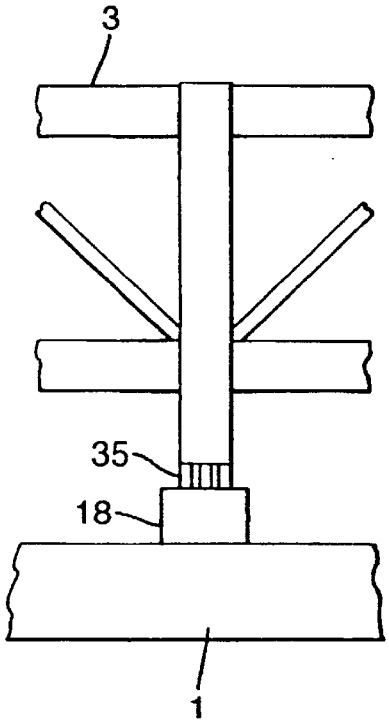
FIG. 8A is an elevation view showing a detail relating to the mounting of a truss on a barge of the vessel at a preliminary stage of the removal process.
Figure 8B:
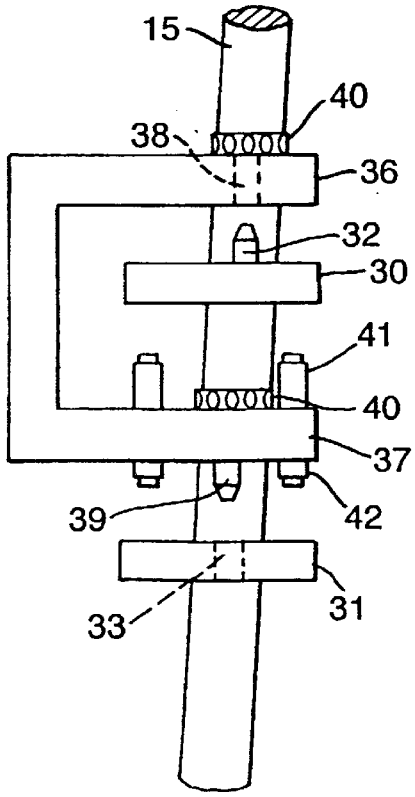
FIG. 8B is an elevation view showing a part of the truss engaging the leg portion of the jacket at the preliminary stage of the removal process.

Referring now also to FIGS. 8A and 8B, the trusses 3, 4 are mounted on jacks 35 on the barges 1, 2 (FIG. 8A shows the arrangement for the truss 3 and the barge 1, but it should be understood that substantially the same arrangement is employed for the truss 4 and for the barge 2). At appropriate places on the trusses 3, 4 they are provided with retractable upper and lower forks 36, 37 respectively, those forks being placed such that when extended (that is moved to the right to the position shown in FIG. 8B) they each encompass a respective leg 15 of the jacket; the height of the truss with the jacks 35 raised is such that the upper fork 36 is above and spaced from the upper collar 30 and the lower fork 37 is above and spaced from the lower collar 31. The pair of arms of the upper fork 36 are each provided with respective bores 38 (one of which is shown in dotted outline in FIG. 8B) which are aligned with the locating pins 32 on the upper collar 30, whilst the pair of arms of the lower fork 37 are each provided with respective downwardly projecting locating pins 39 (one of which is visible in FIG. 8B), which are aligned with the locating bores 33 on the lower collar 31. The locating pins 39 on the lower forks are retractable. The upper and lower forks 36, 37 are also each provided with grippers 40 which, when actuated, grip the leg 15 of the jacket and prevent lateral movement of the jacket leg relative to the truss. The lower fork 37 is also provided with several (for example, four) upper-jacks 41 extending upwardly from the fork and a corresponding set of lower jacks 42 extending downwardly from the fork. As shown in FIG. 8B, the jacks 41, 42 are at this stage retracted and the weight of the deck 13 is transferred to the seabed along the full length of each of the legs 15. The weight of the truss is supported by the barges 1, 2 via the jacks 35 and the grippers 40 are not actuated.

Figure 9A:
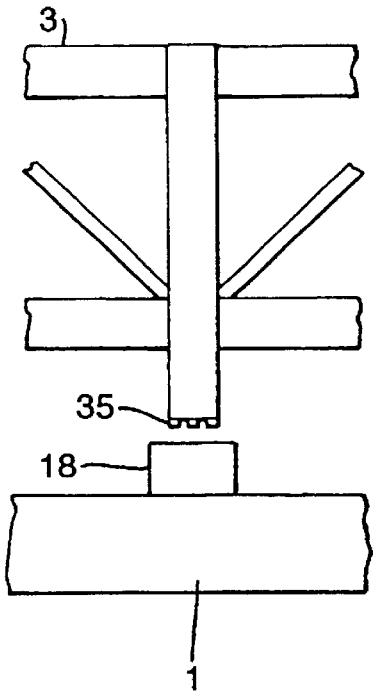
FIG. 9A is an elevation view similar to FIG. 8A but showing the parts at a first subsequent stage of the removal process.

During appropriate sea conditions, the jacks 35 on the barges 1, 2 are retracted and the trusses 3, 4 therefore move down the legs 15 of the jacket until each upper fork 36 rests on a respective upper collar 30 with the pins 32 of the upper collar engaging the bores 38 in the upper fork 36. As the jacks 35 are then further retracted the weight of the trusses is transferred progressively to the legs 15 of the jacket and the barges 1, 2 rise slightly in the water. Once all the weight is transferred, further retraction of the jacks 35 separates them from the barge, as shown in FIG. 9A.

Figure 9B:
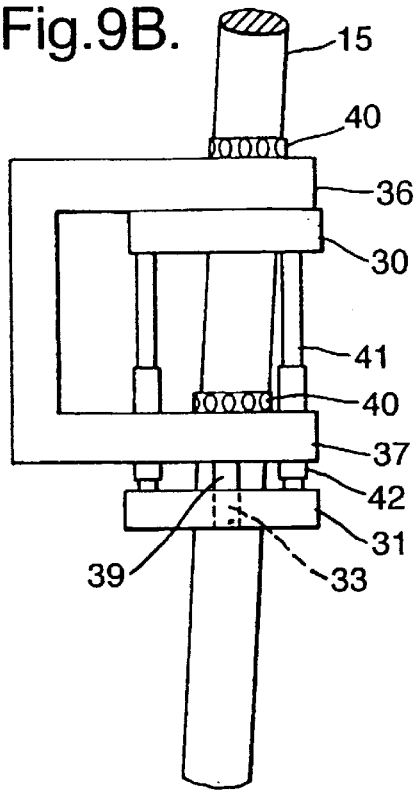
FIG. 9B is an elevation view similar to FIG. 8B but showing the parts at a first subsequent stage of the removal process.

As shown in FIG. 9B, the upper jacks 41 are also extended at this stage until they engage the upper collar 30 thereby securing the connection through the locating pins 32 of the forked part of the truss to the jacket leg 15. Furthermore, the lower jacks 42 are extended downwardly until they engage the lower collar 31, with the locating pins 39 being extended and therefore engaging the bores 33 in the lower collar 31.

The lower jacks 42 are extended sufficiently, not only to contact the lower collar 31 but to bear against the collar with sufficient force to cancel out the compressive load in the portion of the leg between the collars 30 and 31. Thus the vertical compressive load carried in the leg 15 by virtue principally of the weight of the deck passes down the leg 15 from its top as far as the upper collar 30, is then diverted through the collar 30, upper jacks 41, lower fork 37, lower jacks 42 and the lower collar 31, before continuing down the leg 15 to the seabed. Thus the portion of the leg 15 between the collars 30, 31 is substantially unstressed.

Figure 10A:
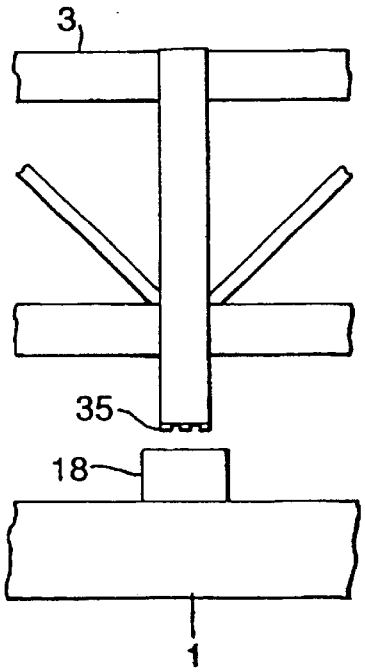
FIG. 10A is an elevation view similar to FIG. 9A but showing the parts at a second stage, subsequent to the stage of FIG. 9A, of the removal process.
Figure 10B:
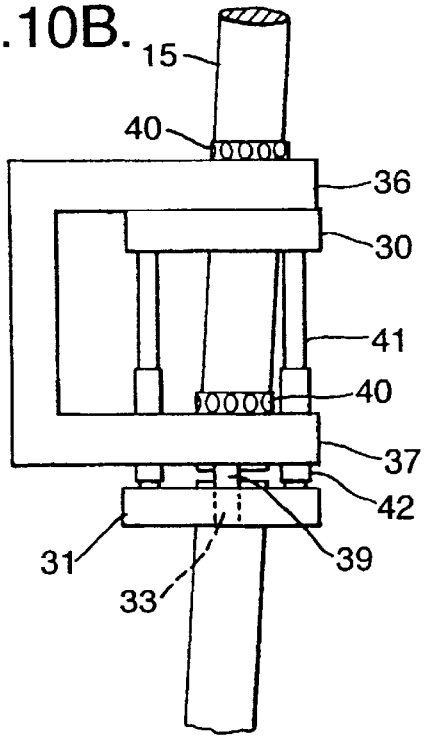
FIG. 10B is an elevation view similar to FIG. 9B but showing the parts at a second stage, subsequent to the stage of FIG. 9B, of the removal process.

The grippers 40 on the upper and lower forks 36, 37 are then actuated to complete the process of connecting the trusses to the jacket legs and, as shown in FIG. 10B, with a portion of the leg 15 substantially unstressed, it is now cut at a position immediately above the lower collar 31. At this stage any diagonal bracing 17 at the level of the cuts through the legs 15 can also be cut, since the trusses 3, 4 are able, via the grippers 40, to provide the necessary support. To facilitate cutting, equipment may be pre-installed on certain members of the jacket.

Figure 11A:
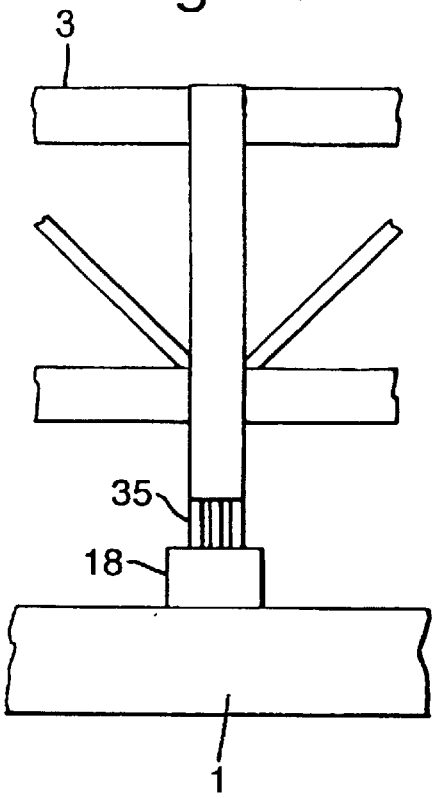
FIG. 11A is an elevation view similar to FIG. 10A but showing the parts at a third stage, subsequent to the stage of FIG. 10A, of the removal process.
Figure 11B:
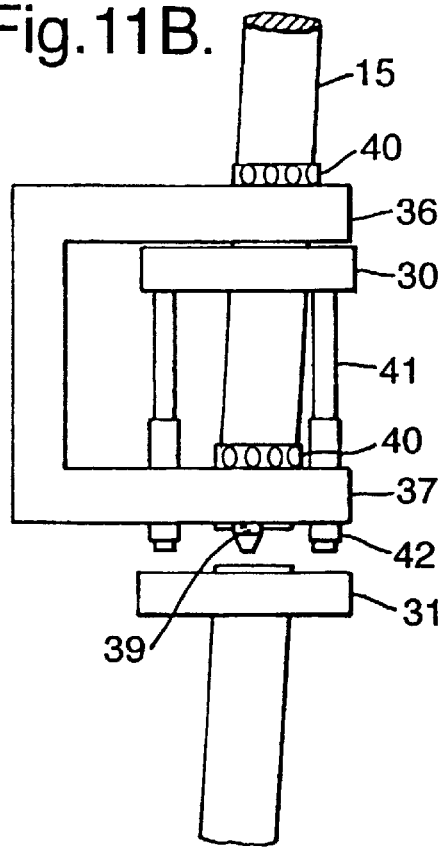
FIG. 11B is an elevation view similar to FIG. 10B but showing the parts at a third stage, subsequent to the stage of FIG. 10B, of the removal process.

Once cutting is complete and provided sea conditions are appropriate the jacks 35 on the trusses 3, 4 are extended. First the jacks engage the barges 1, 2 and then as they are further extended the weight of the part of the jacket 12 above the cut and the weight of the deck 13 is progressively transferred to the barges 1, 2 via the trusses 3, 4. Once all the load has been transferred further extension of the jacks 35 raises the trusses 3, 4 and also raises the upper part of the jacket clear of the lower part. During this raising of the trusses 3, 4 the lower jacks 42 and the locating pins 39 are retracted immediately separating further the upper and lower parts of the jacket in the region of each leg. The vertical load is transferred from the legs of the upper part of the jacket 12 to the trusses 3, 4 via the upper collar 30 and the upper jacks 41; the grippers 40 transfer principally horizontal loads. FIGS. 11A and 11B show the arrangement at the completion of the steps just described.

Figure 12:
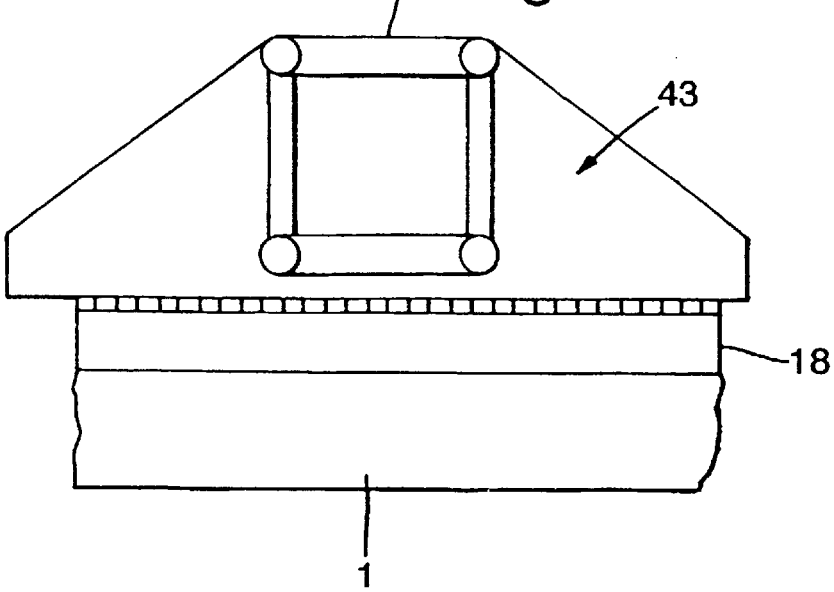
FIG. 12 is a sectional view of the mounting of the truss on the barge of the vessel at a fourth stage, subsequent to the stage of FIG. 11A and viewed in a direction perpendicular to the direction of viewing of FIG. 11A.

As already indicated the vessel 10 is then manoeuvred to a position clear of the lower part of the jacket. At that stage, the jacks 35 are retracted lowering the trusses 3, 4 down onto the decks of the barges 1, 2. As can be seen in FIG. 12, the trusses 3, 4 are provided with integrated skid shoes 43 which extend perpendicular to the trusses and are aligned with and rest upon the longitudinal skid arrangements 18 provided on the barges 1, 2. Once the skid shoes 43 are resting on the barges, appropriate fastenings can be applied to retain the trusses 3, 4, the upper part of the jacket 12 and the deck 13 is position as the vessel is towed to,its destination.

Whilst one particular example of the invention has been described with reference to the accompanying drawings, it will be understood that many variations can be made to the described example without departing from the scope of the invention. One example of a modified arrangement is described below with reference to FIGS. 13, 14A, 14B, 15, 16A and 16B where corresponding parts are referenced with the same reference numerals as in the other drawings.

In the modified arrangement, the only substantive change to the vessel 10 is that the truss 3 comprising separate halves 3A and 3B is replaced by a truss 103 and an associated buoyancy unit 104, with the truss 103 and the buoyancy unit 104 being completely separable from the vessel when required. As can be seen for example in FIGS. 14A and 14B, the buoyancy unit 104 is mounted immediately below the truss 103 along a middle portion only of the length of the truss.

Figure 13:
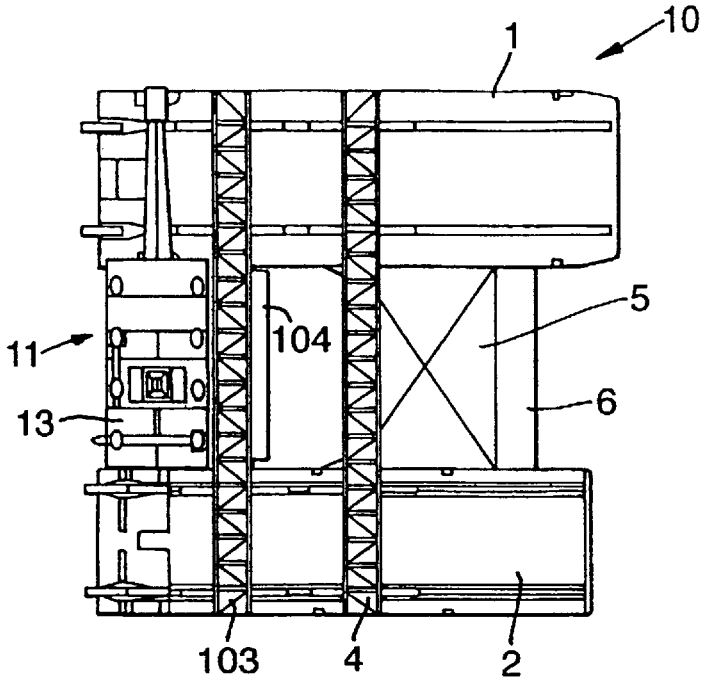
FIG. 13 is a plan view of a modified vessel positioned around an offshore structure in an early stage of a second method.
Figure 14A:
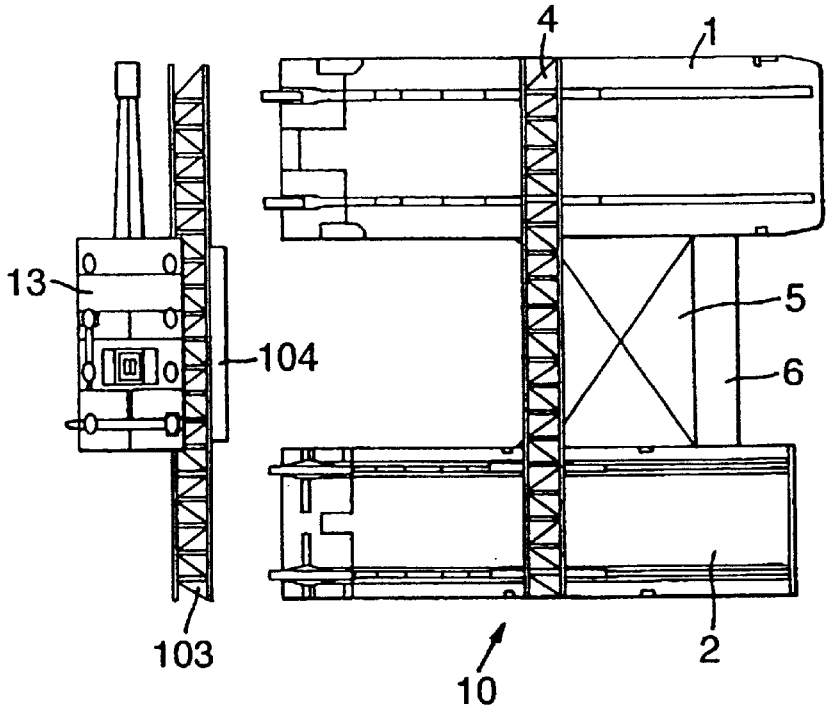
FIG. 14A is a plan view of the modified vessel positioned in the vicinity of the offshore structure in a subsequent stage of the second method.
Figure 14B:
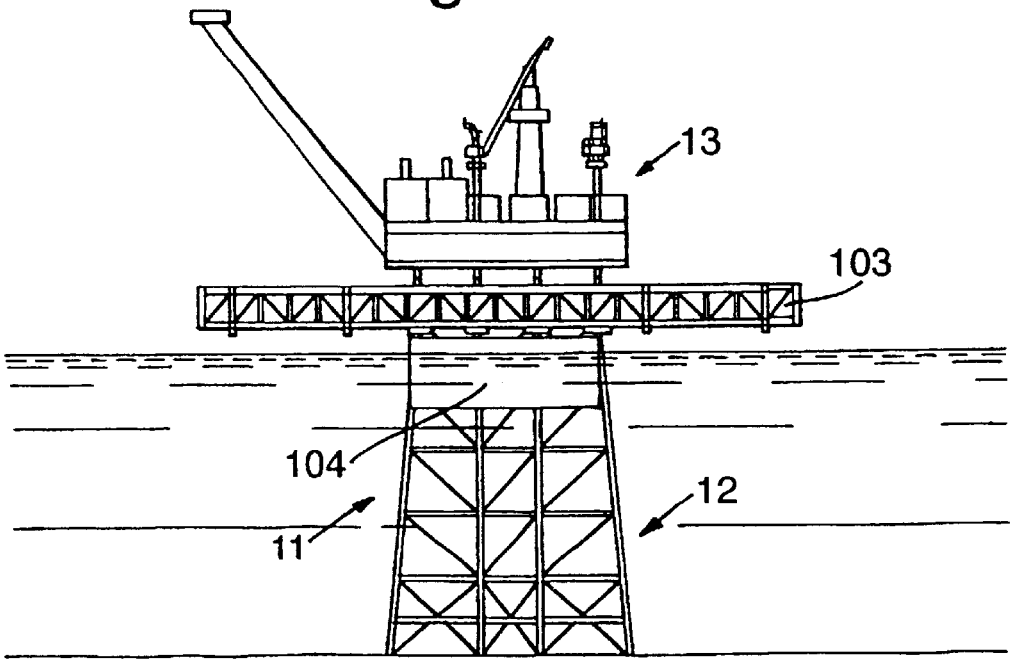
FIG. 14B is an elevation view of the arrangement shown in plan view in FIG. 14A.

In use, the vessel 10 is brought into the position shown in FIG. 13 with the offshore structure 11, from which the deck 13 is to be removed, positioned between the stern portions of the barges 1, 2 and with the truss 103 immediately adjacent to the structure 11. While the vessel is being brought into the position shown in FIG. 13, the weight of the truss 103 and of the buoyancy unit 104 is taken wholly or substantially by the barges 1, 2 with the buoyancy unit 104 being held either entirely above sea level or at least above a position in which it serves to support a significant part of the weight of the truss 103. Once the vessel 10 is in the position shown in FIG. 13, however, it is ballasted down to such an extent that the buoyancy unit 104 is sufficiently submerged in the sea that it takes not only its own weight but also the weight of the truss 103. At this stage the truss 103 is temporarily secured to the jacket 12, but it will be understood that this securing need not be a major load bearing connection, because the weight of the truss 103 is taken by the buoyancy unit 104. As shown in FIG. 14B, the buoyancy unit 104 projects, when viewed in plan, beyond the truss 103 in a direction away from the structure 11, but does not project beyond the truss 103 in the opposite direction, thus enabling the truss 103 to be positioned immediately adjacent to the jacket 12.

After completion of ballasting down of the vessel 10 and temporary securing of the truss 103 to the jacket 12, the vessel 10 is withdrawn from the structure 11 leaving the truss 103 and buoyancy unit 104 with the structure 11. This situation is shown in FIGS. 14A and 14B (with the vessel 10 not being shown in FIG. 14B).

Figure 15:
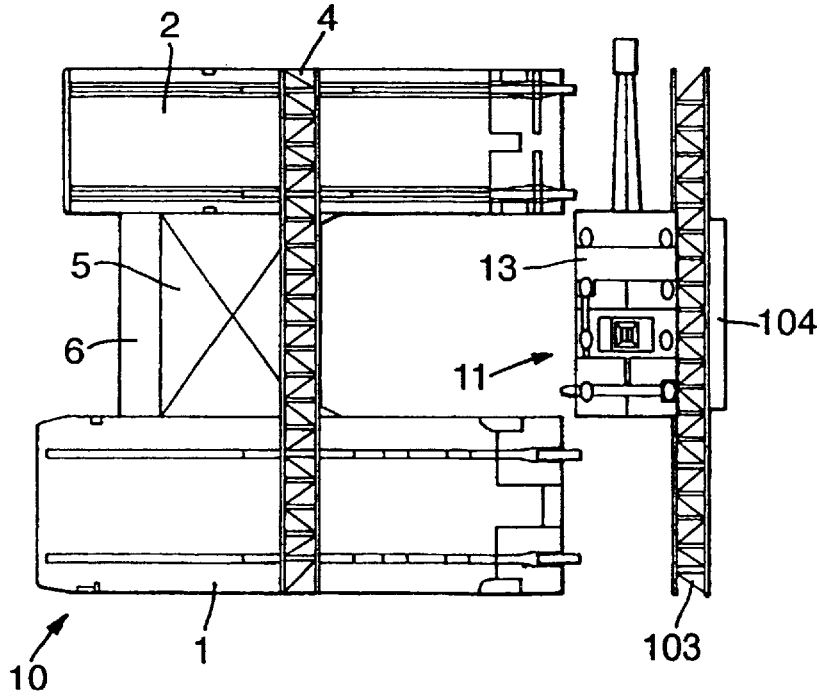
FIG. 15 is a plan view of the modified vessel after it has moved to a new position in the vicinity of the offshore structure in a subsequent stage of the second method.
Figure 16A:
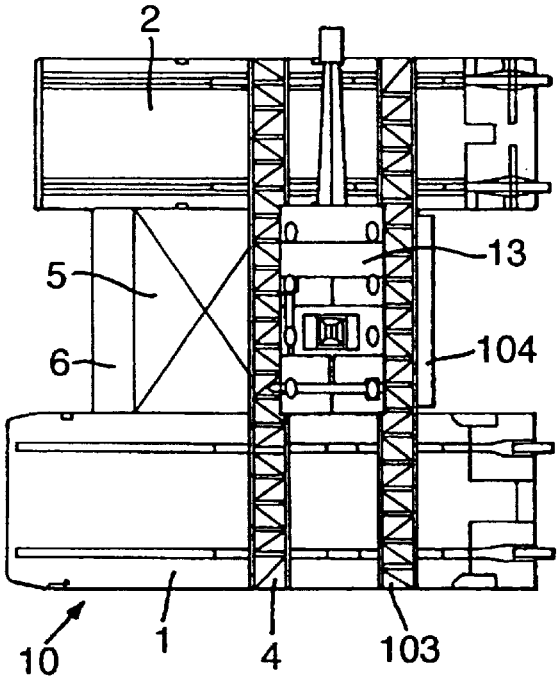
FIG. 16A is a plan view of the modified vessel positioned again around the offshore structure in a subsequent stage of the second method.
Figure 16B:
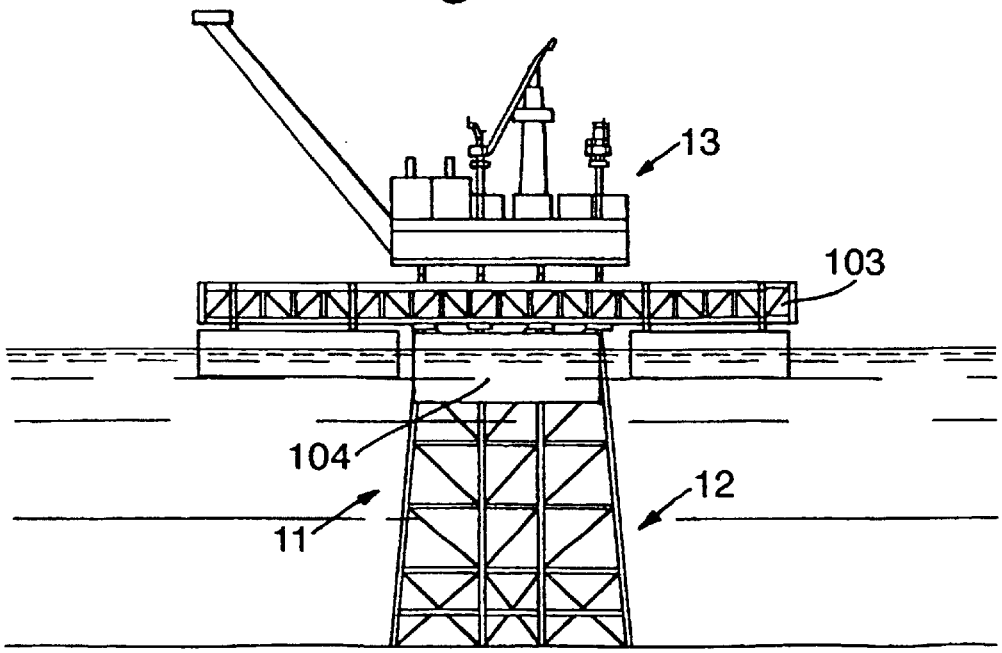
FIG. 16B is an elevation view of the arrangement shown in plan view in FIG. 16A.

The vessel 10 is then manoeuvred around to the other side of the structure 11 and turned through 180° so as to bring it into the position shown in FIG. 15. Then the vessel 10 is moved towards the structure 11 into the position shown in FIG. 16A, with the barges 1, 2 passing under the truss 103 and on first and second opposite sides of the structure 11 and the buoyancy unit 104. The trusses 103 and 4 extend between the barges 1, 2 on third and fourth opposite sides of the structure 11. Once the vessel is in the position shown in FIG. 16A, ballast is removed to raise the vessel to a position in which it is once again supporting the truss 103, as shown in FIG. 16B, and the temporary securing of the truss 103 to the jacket 12 is released.

Figure 4A:
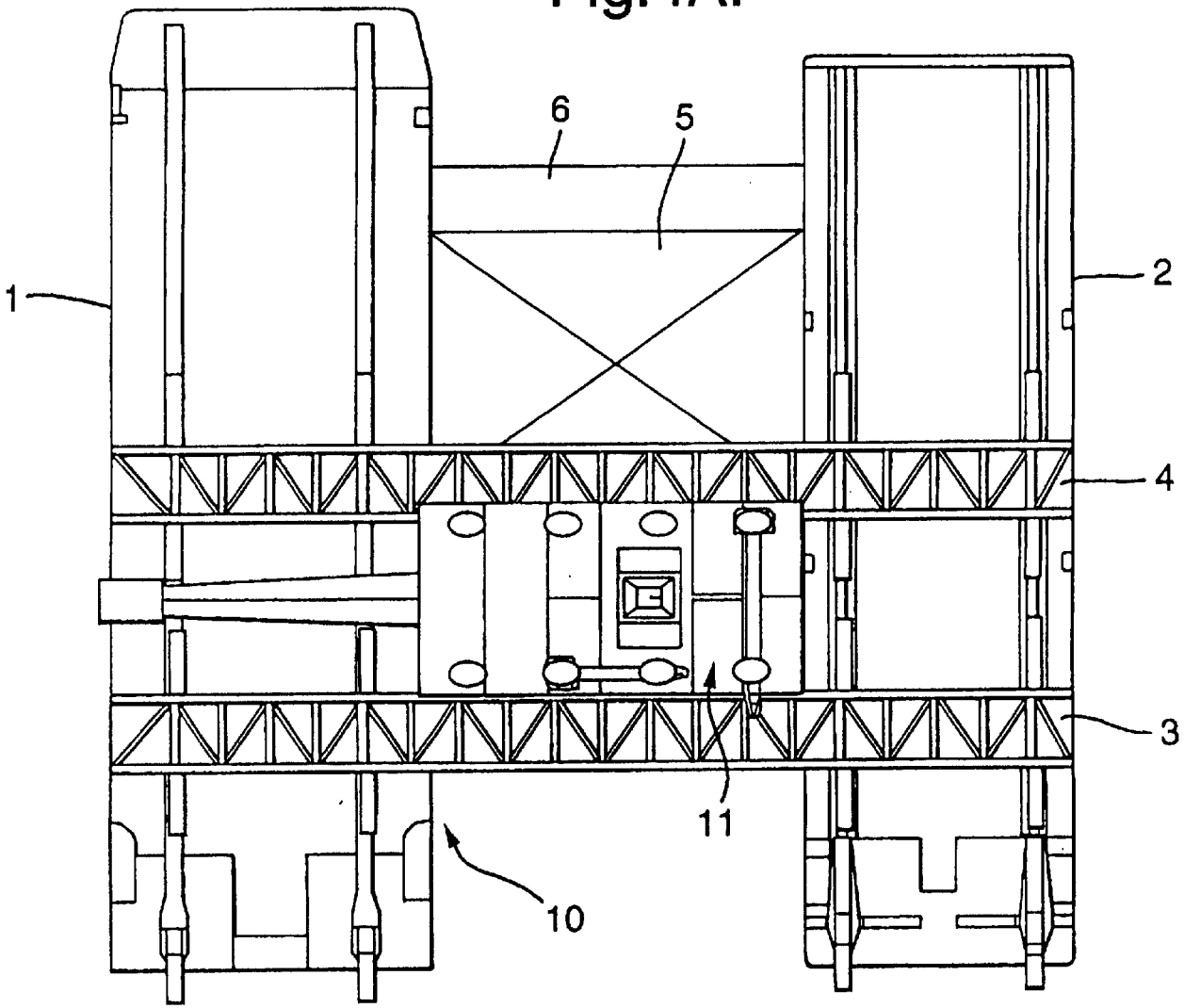
FIG. 4A is a plan view of the vessel fixed in position around the structure.
Figure 4B:
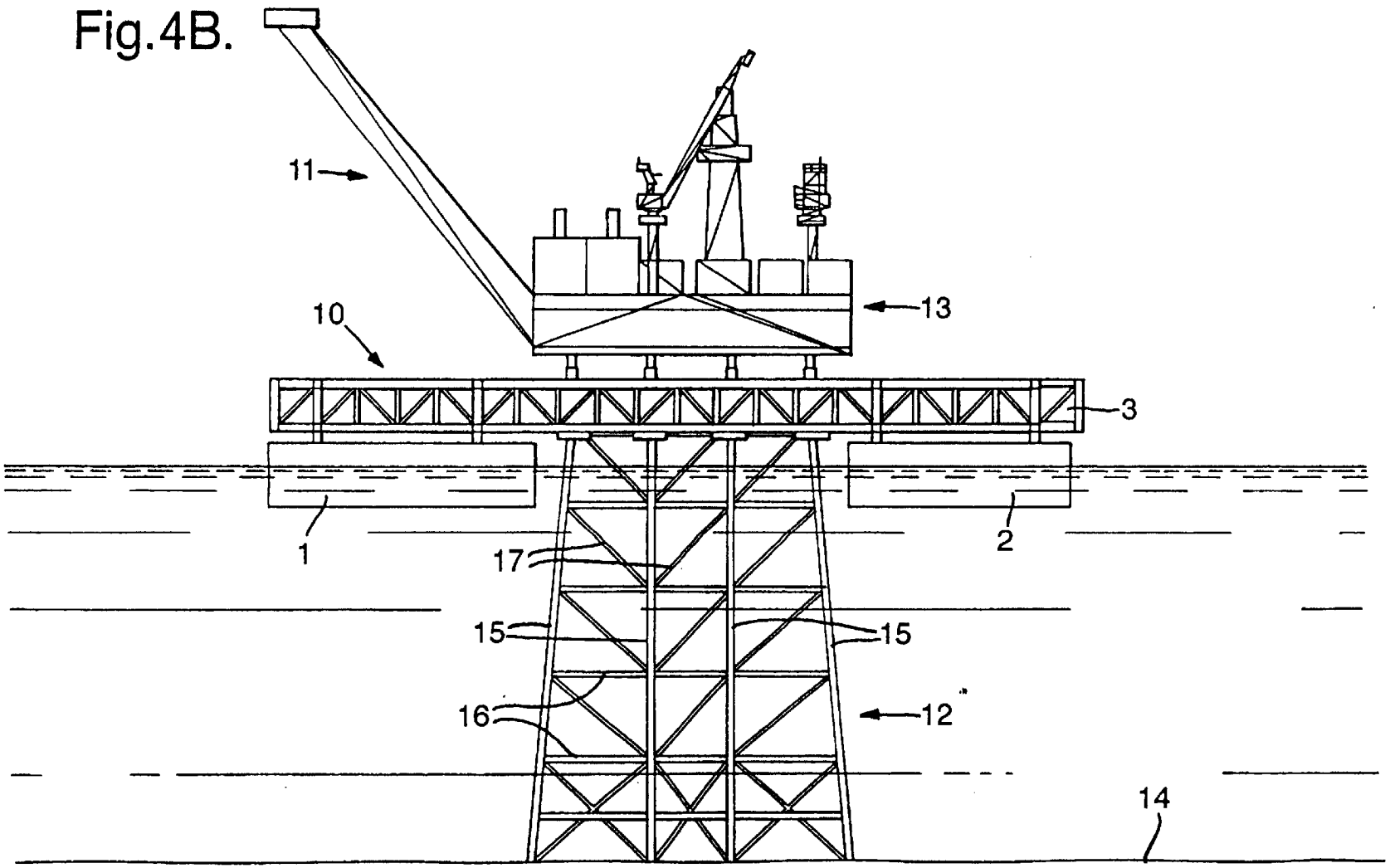
FIG. 4B is an elevation view of what is shown in plan view in FIG. 4A.

It will be appreciated that the arrangement reached at this stage is substantially the same as that shown in FIGS. 4A and 4B. The procedure subsequently followed in the modified embodiment employing the truss 103 is substantially the same as that described above with reference to FIGS. 5 to 12, with references to the truss 3 being treated as references to the truss 103.

What is claimed is:

1. A method of removing a deck from an offshore structure including a deck supported on a jacket, the method including the following steps:

a) positioning a floating vessel around the jacket with respective parts of the vessel on opposite sides of the jacket and trusses extending between and connecting the opposite parts of the vessel, b) engaging parts of the trusses with legs of the jacket, c) securing the trusses to the jacket, d) relieving the load carried by portions of the legs of the jacket, e) cutting through the portions of the legs of the jacket to divide the jacket into a lower part and an upper part carrying the deck, the trusses being secured to the upper part of the jacket, f) transferring the weight of the upper part of the jacket and of the deck via the trusses to the floating vessel, and g) removing the floating vessel, with the trusses, the upper part of the jacket and the deck supported thereon, from the vicinity of the lower part of the jacket.

2. A method according to claim 1, in which the trusses are secured to the jacket above sea level.

3. A method according to claim 1, in which the legs are cut above sea level.

4. A method according to claim 1, in which the floating vessel includes two barges for positioning on opposite sides of the jacket.

5. A method according to claim 4, in which the barges are able to be separated and used for another purpose as individual barges.

6. A method according to claim 4, in which the barges are connected together side-by-side with a space therebetween, by front and rear trusses.

7. A method according to claim 6, in which one of the trusses is retractable to leave an open-ended space between the barges.

8. A method according to claim 7, in which the truss is retracted by being separated into two parts.

9. A method according to claim 7, in which step (a) of positioning the floating vessel includes the sequential steps of retracting the retractable truss, positioning the vessel around the jacket with the barges on opposite sides of the jacket and the jacket positioned within the open-ended space, and returning the retracted truss to a position in which it extends across the gap between the barges on the opposite side of the jacket from the other truss.

10. A method according to claim 1, in which step (a) of positioning the floating vessel around the jacket includes the following steps:

(i) positioning the vessel adjacent to the jacket with one of the trusses immediately adjacent to the jacket and engaging a part of the truss immediately adjacent to the jacket with the jacket, (ii) releasing the truss that is immediately adjacent to the jacket from the vessel, and (iii) moving the vessel away from the jacket and then to an opposite side of the jacket and repositioning the vessel around the jacket with respective parts of the vessel on first and second opposite sides of the jacket and the trusses extending between the opposite parts of the vessel on third and fourth opposite sides of the jacket.

11. A method according to claim 10, in which the truss that is immediately adjacent to the jacket is mounted on a buoyancy unit which supports at least most of the weight of the truss when the truss is released from the vessel.

12. A method according to claim 10, in which the step of releasing the truss that is immediately adjacent to the jacket from the vessel includes the step of adding ballast to the vessel to lower it.

13. A method according to claim 1, in which step (b) of engaging parts of the trusses with legs of the jacket includes moving movable parts of the trusses into engagement with the legs.

14. A method according to claim 13, in which each leg is engaged by a part of one of the trusses at two locations vertically spaced from one another.

15. A method according to claim 1, including a preliminary step of fixing at least one collar to each leg.

16. A method according to claim 1, in which the parts of the trusses that engage the legs include grippers that are able to transfer horizontal loads between the legs and the trusses.

17. A method according to claim 1, further including the step of detaching the trusses from the vessel after the trusses are secured to the jacket.

18. A method according to claim 17, in which the step of detaching the trusses includes the step of retracting jacks positioned between the vessel and the trusses.

19. A method according to claim 17, in which step (f) of transferring the weight of the upper part of the jacket and of the deck via the trusses to the floating vessel includes the step of reattaching the trusses to the vessel.

20. A method according to claim 1, in which step (d) of relieving the load carried by portions of the legs of the jacket involves the steps of placing jacking systems around portions of the legs of the jacket, and actuating the systems such that vertical loads previously carried through the portions of the legs are carried through the jacking systems.

21. A method according to claim 1, in which step (e) of cutting through the portions of the legs of the jacket includes the step of cutting through diagonal bracing of the jacket.

22. A method according to claim 1, further including the step of taking the vessel to shore and transporting the trusses, with the upper part of the jacket and the deck supported thereon, onto the shore.

23. A vessel suitable for carrying out a method according to claim 1.

24. A method of removing a deck from an offshore structure including a deck and a jacket, the method including the following steps:

placing jacking systems around portions of the legs of the jacket, actuating the jacking systems to relieve the load carried by the portions of the legs of the jacket, cutting through the portions of the legs of the jacket to divide the jacket into a lower part and an upper part carrying the deck, and removing the deck from the jacket.

25. A method of removing a deck from an offshore structure, the method including the following steps:

providing a floating vessel comprising two barges, connected together side-by-side with a space therebetween, by front and rear trusses, positioning the vessel adjacent to the structure with one of the trusses immediately adjacent to the structure and engaging a part of the truss immediately adjacent to the jacket with the jacket, releasing the truss that is immediately adjacent to the structure from the vessel, moving the vessel away from the structure and then to an opposite side of the structure and repositioning the vessel around the structure with the barges on first and second opposite sides of the structure and the trusses extending between the barges on third and fourth opposite sides of the structure, transferring the load of the deck via the trusses to the barges, and removing the barges, with the trusses and the deck supported thereon.

26. A method removing a deck from an offshore structure, the method including the following steps:

providing a floating vessel comprising two barges connected together side-by-side with a space therebetween, by front and rear trusses, retracting one of the trusses to leave an open-ended space between the barges, positioning the vessel around the structure with the barges on opposite sides of the structure and the structure positioned within the open-ended space, returning the retracted truss to a position in which it extends across the gap between the barges on the opposite side of the structure from the other truss, transferring the load of the deck via the trusses to the barges, and removing the barges, with the trusses and the deck supported thereon.

27. A method of removing a deck from an offshore structure including a deck supported on a jacket, the method including the following steps:

positioning a floating vessel around the jacket with respective parts of the vessel on opposite sides of the jacket and one or more trusses extending between the opposite parts of the vessel, securing the trusses to the jacket, detaching the trusses from the vessel, cutting through the jacket to divide the jacket into a lower part and an upper part carrying the deck, the trusses being secured to the upper part of the jacket, reattaching the trusses to the vessel and transferring the weight of the upper part of the jacket and of the deck via the trusses to the floating vessel, and removing the floating vessel, with the trusses, the upper part of the jacket and the deck supported thereon from the vicinity of the lower part of the jacket.

* * * * *